US005949318A

United States Patent [19]

Copeland et al.

[11] Patent Number: 5,949,318

[45] **Date of Patent: *Sep. 7, 1999**

[54] APPARATUS FOR ACTIVATING/ DEACTIVATING SENSORS USED WITH EAS TAGS

[75] Inventors: Richard L. Copeland; Markus B. Kopp; Paul N. Manente, all of Boca Raton, Fla.

[73] Assignee: Sensormatic Electronics Corporation, Boca Raton, Fla.

[ * ] Notice: This patent is subject to a terminal disclaimer.

[21] Appl. No.: 08/288,088

[22] Filed: Aug. 10, 1994

[51] Int. Cl.[6] ..... H01F 7/02

[52] U.S. Cl. ..... 335/306; 340/572.1

[58] Field of Search ..... 335/302, 306; 340/572, 551, 572.1–572.8; 186/68

[56] References Cited

U.S. PATENT DOCUMENTS

| | | | |
|---|---|---|---|
| 3,781,661 | 12/1973 | Trikilis . | |
| 4,510,489 | 4/1985 | Anderson, III et al. | 340/572 |
| 4,574,274 | 3/1986 | Pinneo | 340/572 |
| 4,686,515 | 8/1987 | Anderson et al. | 340/572 |
| 4,746,908 | 5/1988 | Montean | 340/572 |
| 4,752,758 | 6/1988 | Heltemes | 335/284 |
| 5,126,720 | 6/1992 | Zhou et al. | 340/572 |
| 5,170,045 | 12/1992 | Bengtsson . | |
| 5,410,296 | 4/1995 | Montbriand et al. | 340/572 |
| 5,495,230 | 2/1996 | Lian | 340/551 |

*Primary Examiner*—Lincoln Donovan
*Attorney, Agent, or Firm*—Paul T. Kashimba; John J. Torrente

[57] ABSTRACT

An apparatus for use in activating and/or deactivating an EAS tag which comprises a support, a first number of one or more first discrete small magnets arranged in a first row and a second number of one or more second discrete small magnets arranged in a second row. Each first discrete small magnet is situated adjacent a second discrete small magnet and has a first region of a first magnetic polarity and a second region supported on the support of a second magnetic polarity. Each second discrete small magnet has a first region of the second magnetic polarity and a second region supported on the support and of the first magnetic polarity.

25 Claims, 6 Drawing Sheets

APPARATUS FOR ACTIVATING/ DEACTIVATING SENSORS USED WITH EAS TAGS

BACKGROUND OF THE INVENTION

This invention relates to an apparatus for use with electronic article surveillance ("EAS") systems, and, in particular, to an apparatus for activating and/or deactivating EAS tags used in such systems.

In the field of electronic article surveillance, EAS tags which incorporate some type of magnetic sensor assembly are placed on merchandise such as audio or video tape cassettes (compact discs) to prevent unauthorized removal of the tape cassettes from a store. In a first type of EAS tag, the magnetic sensor assembly includes a magneto-mechanical active element which mechanically vibrates to generate a detectable signal at the frequency of an applied interrogation signal. In a second type of EAS tag, the magnetic sensor assembly includes a soft magnetic active element which generates a detectable signal at a harmonic of the frequency of the applied interrogation signal.

In both types of EAS tags, the magnetic sensor element also includes a hard or semi-hard magnetic biasing element. By changing the magnetic state of this biasing element, the active element of the tag is enabled or disabled from generating the detectable signal, thereby activating or deactivating the tag.

In the case of a magneto-mechanical tag, the biasing element is magnetized along its longer length dimension by a permanent magnet to activate the tag. By either degaussing the biasing element along its length or magnetizing it along its shorter width dimension, the tag is deactivated. In the case of a harmonic tag, when the biasing element is demagnetized, the tag is activated. By magnetizing the biasing element along its longer length dimension, the tag is then deactivated. Degaussing the biasing element along its length then again activates the tag.

In magnetizing, degaussing or changing the state of the biasing element of the aforesaid tags, care must be taken to prevent the magnetic field being used from extending beyond the tag into the merchandise. This can harm certain merchandise, particularly the above-mentioned prerecorded audio and video cassettes which are generally adversely affected by magnetic fields greater than 100 and 200 oersteds, respectively.

U.S. Pat. No. 4,752,758 to Heltemes discloses a demagnetizer used to degauss the biasing element of a harmonic tag so as to activate the tag. In the demagnetizer of the '758 patent, a magnetic sheet material is employed and is provided with successively magnetized sections along the length of the sheet. These sections alternate in magnetic polarity and decrease in intensity so that when a tag is moved along the length of the sheet its biasing element is degaussed. This patent also mentions that the alternating polarity regions are closely spaced to result in a rapid decrease in intensity of the field above the surface upon which the tag is moved so as not to adversely affect a magnetically sensitive object contained within the article carrying the tag.

The demagnetizer of the Heltemes patent provides an effective way of activating a harmonic EAS tag, while limiting the affect of the demagnetizer on articles by providing a degaussing field which decreases when moving away from the demagnetizer. However, the demagnetizer is not usable to deactivate (e.g., magnetize the biasing element of) a harmonic EAS tag, nor is it usable to activate a magneto-mechanical EAS tag.

It is, therefore, an object of the present invention to provide an improved apparatus for activating and/or deactivating a magneto-mechanical EAS tag and for deactivating a harmonic EAS tag.

It is a further object of the present invention to provide an apparatus meeting the above objective and which has a fast magnetic field falloff with distance, thereby limiting the penetration of the magnetic field into the merchandise carrying the tag.

It is a further object of the present invention to provide an improved apparatus meeting the above objectives and which is compact, simple in construction and economical to manufacture.

SUMMARY OF THE INVENTION

In accordance with the principles of the present invention, the above and other objectives are realized in an apparatus which comprises a support member which supports a first number of one or more discrete first magnets and a second number of one or more discrete second magnets. Each first magnetic and each second magnet has first and second opposing regions and each first magnet is supported on the support on its first region and is adjacent to a second magnet which is also supported on the support on its first region. Each first magnet has a first magnetic polarity at its first region and second opposing magnetic polarity at its second region. Each second magnet, in turn, has the second magnetic polarity at its first region and the first magnetic polarity at its second region.

Each first magnet is arranged in a first row and each second magnet is arranged in a second adjacent row. Each first magnet and each second magnet is a small magnet, i.e., a magnet having a dimension in a direction transverse to the direction of its respective row which is less than 0.25 in. or 6.35 mm.

In a first form of the invention, the first number of first magnets comprises a plurality of small discrete cylindrically-shaped permanent small magnets arranged one after the other in the first row and the second number of second magnets also comprises a plurality of discrete cylindrically-shaped permanent small magnets arranged one after the other in the second row. In a second form of the invention, the first number of one or more first magnets comprises a first small permanent strip magnet arranged along the first row and the second number of one or more second magnets comprises a second small permanent strip magnet arranged along the second row.

By suitable selection of the numbers of first and second magnets, the magnetic apparatus can be used as an activator or a deactivator.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
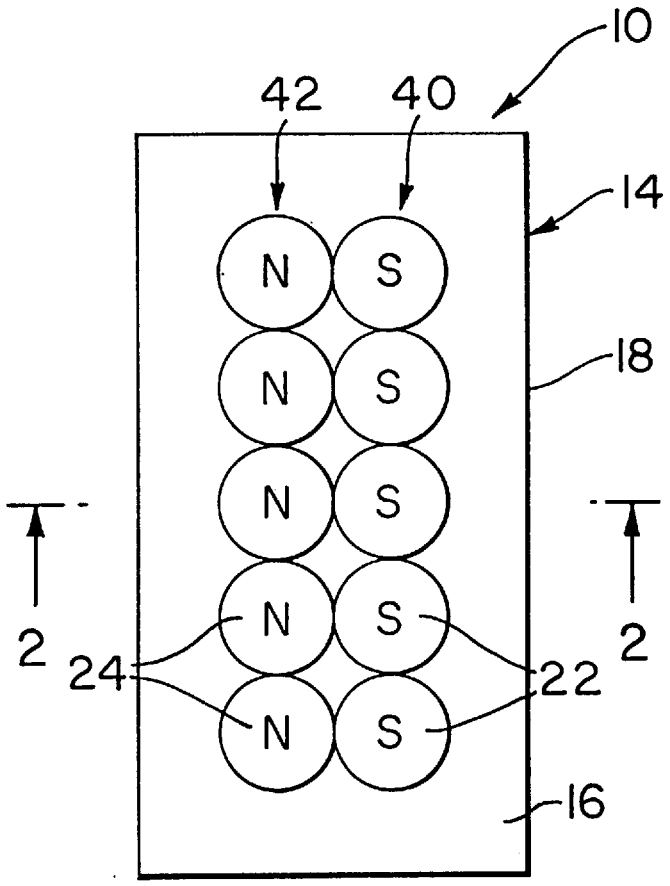
FIG. 1 shows a top view of an apparatus for activating EAS tags used in an article surveillance system in accordance with the present invention.
Figure 2:
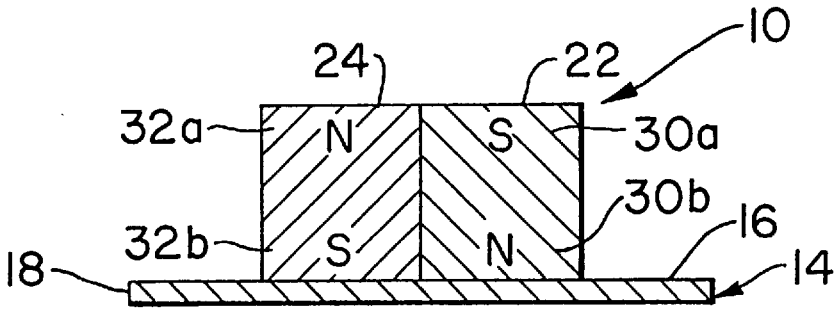
FIG. 2 shows a cross-sectional view of the apparatus of FIG. 1 taken along the lines 2—2 of FIG. 1.

As illustrated in FIGS. 1 and 2, the apparatus 10 of the invention comprises a support or plate 14 made of low carbon steel. The support 14 has a top surface 16 and a surrounding edge 18. First and second pluralities of like cylindrically-shaped discrete small permanent magnets 22 and 24 are positioned on the support 14 in two adjacent rows 40 and 42 extending along a portion of the length of the support 14. This positions each magnet 22 adjacent to another magnet 22 in its row 40 as well as adjacent to a magnet 24 in the row 42. Similarly, each magnet 24 is adjacent to another magnet 24 in its row 42 and adjacent to a magnet 22 in the row 40.

FIG. 2 illustrates a cross-section view of two adjacent magnets 22 and 24. As can be seen, the magnet 22 has a first or south magnetic polarity at its top region 30*a* and a second or north magnetic polarity at its bottom region 30*b* which is supported on the support 14. The magnet 24, on the other hand, has the second or north magnetic polarity at its top region 32*a* and the first or south magnetic polarity at its bottom region 32*b* which is supported on the support 14. Adjacent magnets 22 and 24 in the rows 40 and 42 thus have top regions of opposite magnetic polarity and bottom regions of opposite magnetic polarity.

As above-indicated, each of the magnets 22 and each of the magnets 24 is a small magnet by which is meant each has a dimension transverse to the direction of its respective row which is equal to or less than 0.25 in. or 6.35 mm. In the case of the magnets 22 and 24 which are cylindrical in shape, each magnet has a diameter less than or equal to 0.25 in. or 6.35 mm.

Figure 7:
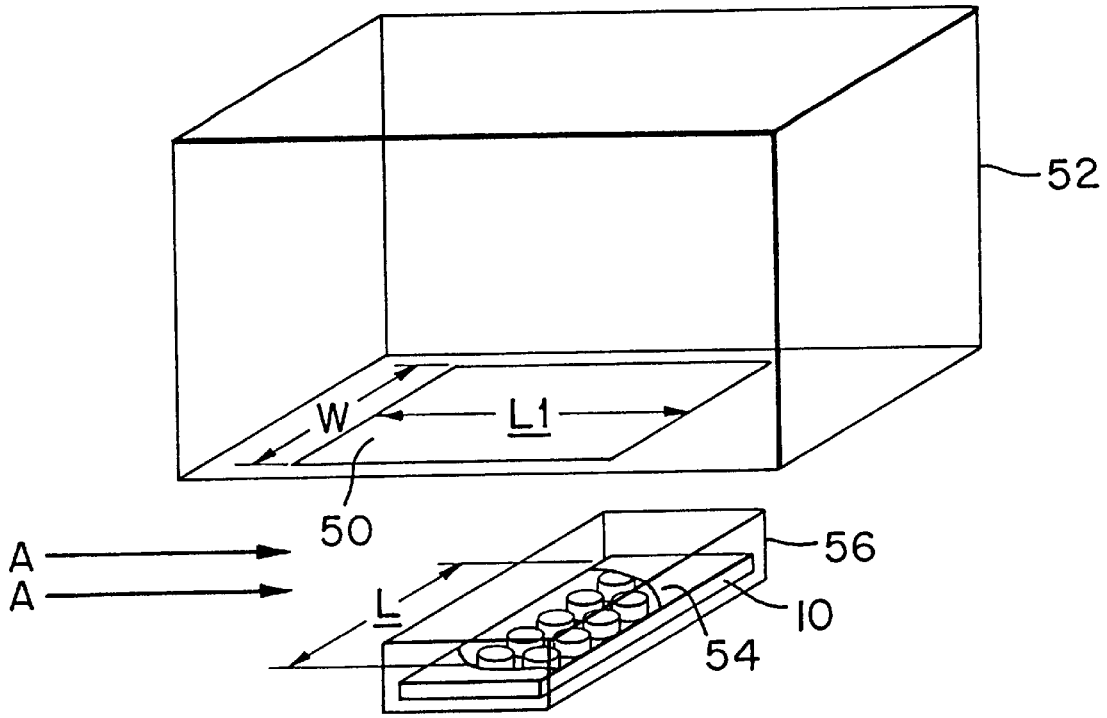
FIGS. 7 and 8 show views of the apparatus of the invention positioned to activate and deactivate, respectively, a biasing element in an EAS tag attached to a product.
Figure 8:
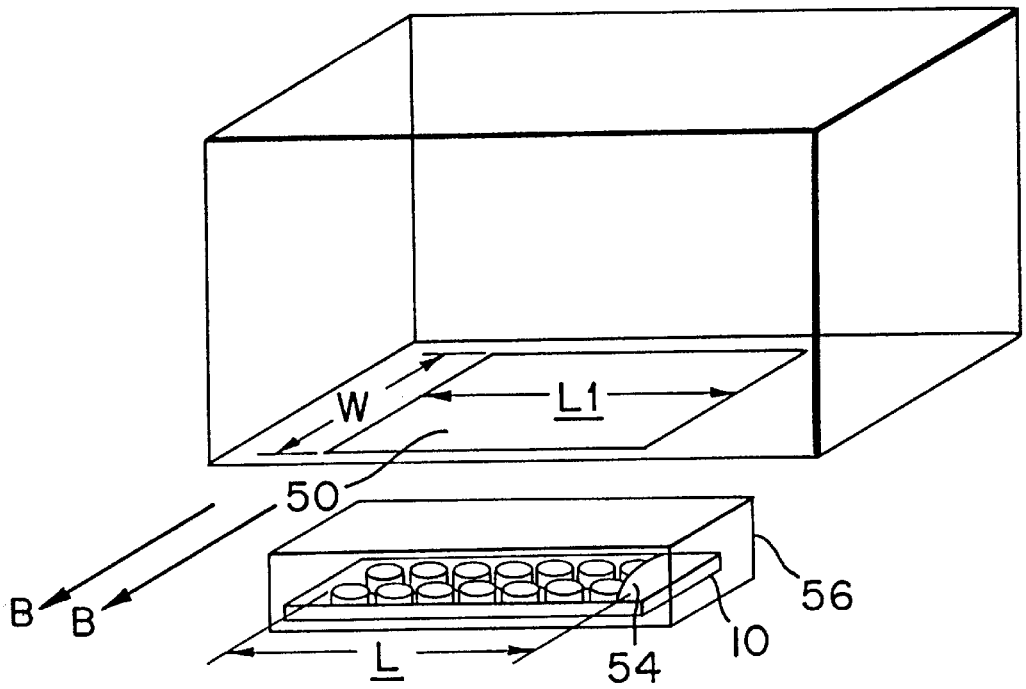

With the apparatus 10 configured as aforesaid, the apparatus provides a magnetic field above the magnets which is relatively confined and close to the magnets and has a fast roll-off with distance beyond a relatively close distance to the magnets. The apparatus 10 thus has characteristics which make it suitable for use in magnetizing the biasing element in a magneto-mechanical EAS tag 50 attached to a tape cassette 52 to activate and deactivate the tag. This is shown in FIGS. 7 and 8 and will be described more fully below. The characteristics of the apparatus 10 for this purpose are further enhanced by the magnetically soft steel support 14 which provides a low reluctance path for the magnetic flux of the magnets. This confines the magnetic field at the bottom of the magnets to within the support 14.

Each magnet 22 and 24 may be adhered or attached to the support 14 by some type of adhesive means such as glue or epoxy. In addition, a retainer 54, such as a plastic collar, thin film or other securing member may be used to hold the magnets in place on the support 14 as shown in FIG. 7.

The specific size and shape of the apparatus 10 is dependent upon the intended application of the apparatus. For example, if the apparatus 10 is to be used to activate or deactivate an EAS tag 50 which is placed on an audio tape cassette then the small magnets 22 and 24 can be smaller in size. On the other hand, if the tag 50 is placed on a video tape cassette, larger size small magnets may be required. Preferably, however, the size and number of small magnets used are chosen so that the magnetic field produced diminishes rapidly. Specifically, near the top of the magnets, a field intensity of above about 300 Gauss or higher exists, but at a distance of about 10 mm, the field intensity drops to less than or about 30 Gauss.

An apparatus 10 meeting the above roll-off criteria has been fabricated using a steel support 14, with the support having a width of 0.5" a length of 1.00" and a height of 0.15". This apparatus used five adjacent small magnets 22 and five adjacent small magnets 24 as shown in FIG. 1. Each magnet was comprised of samarium cobalt (SmCo) or neodymium iron boron (NdFeB) and each had a diameter of 0.254 cm.

As above indicated, the apparatus 10 allows for very rapid magnetic field falloff with distance owing to the size of the magnets 22 and 24, their opposite polarity and the size of the support 14. With this rapid magnetic falloff rate, the apparatus 10 is thus highly suitable for use as an activator and/or deactivator of an EAS tag, since the field from the apparatus is prevented from entering into the article carrying the tag. This is especially desirable in the case of audio or video cassettes to prevent damage or harm to the information recorded on the cassette tape.

As shown in FIG. 7, the apparatus 10 is used to activate a magneto-mechanical EAS tag 50 attached or adhered to a product 52, such as a video or audio tape cassette, to prevent unauthorized removal of the cassette 52 from a store. Such a magneto-mechanical EAS tag 50 is sold under the trademark, ULTRAMAX and is disclosed in U.S. Pat. No. 4,510,489 (Anderson, III et al.), the teachings of which are incorporated herein by reference.

As illustrated in FIG. 7, the EAS tag 50 is positioned on the cassette 52 so that the biasing element in the EAS tag 50 is to be magnetized along its long axis (i.e., along the length of the tag 50) to activate the tag. To accomplish this, the apparatus 10 is first positioned adjacent the wall of the cassette 52 which supports the EAS tag 50. This positioning is such that the length of the apparatus 10 and, therefore, the axis of the rows of the magnets 22 and 24 is perpendicular to the length of the tag. Also, the entire length L of the two rows of magnets is sufficient to span the width W of the tag and thus the width of its biasing element.

The apparatus 10 is then held stationary, and the cassette 52 with the tag 50 attached thereto is moved across the apparatus 10 in a sweeping manner as indicated by lines A. This causes the biasing element in the tag 50 to be magnetized along the length L1 of the tag, thereby activating the tag. Alternatively, the cassette 52 can be held stationary and the apparatus 10 may be swept across the tag 50. This likewise causes the biasing element in the EAS tag to be magnetized along the tag length.

The magnetized polarity of the biasing element of the tag 50 will be the same for either sweep direction. Sweeping the apparatus 10 and cassette 52 in one direction relative to one another will thus result in the biasing element having a north magnetic polarity at one end and a south magnetic polarity at the other end. Relatively sweeping in the opposite direction will result in the same magnetic polarities at these ends.

Figure 3:
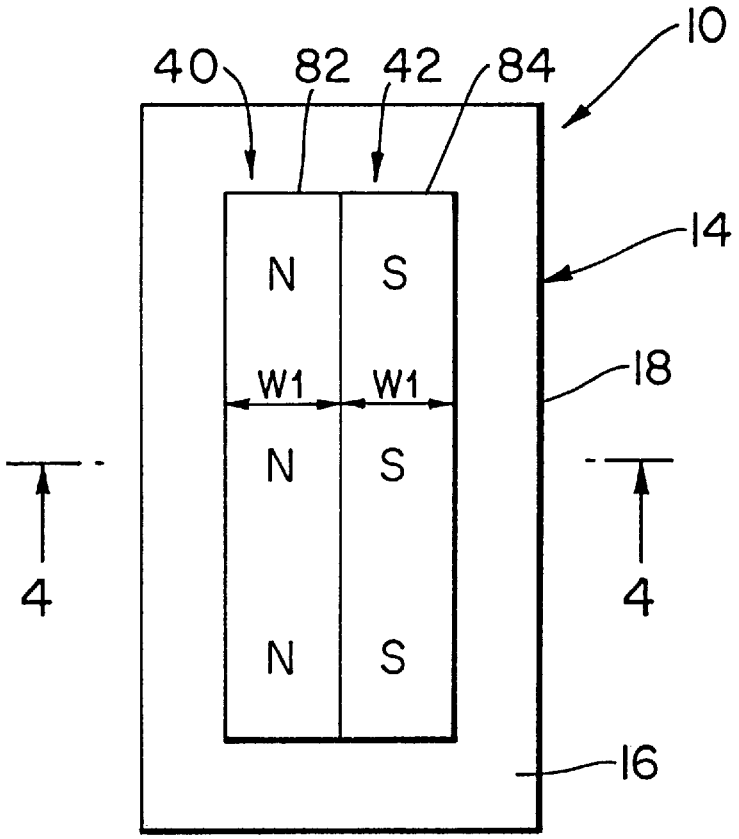
FIG. 3 shows a top view of a modified embodiment of the apparatus of the invention.
Figure 4:
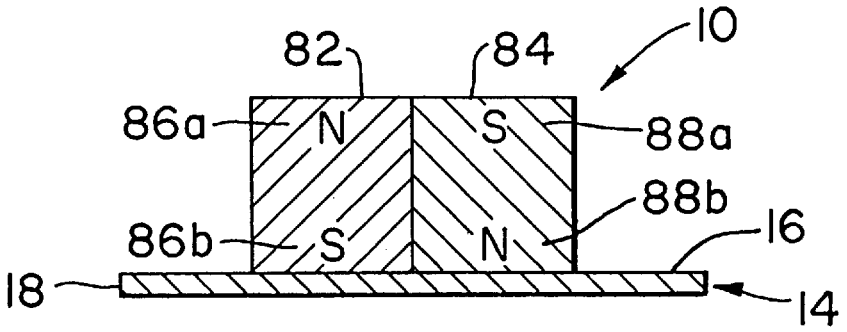
FIG. 4 shows a cross-sectional view of the apparatus of FIG. 3 taken along the lines 4—4 of FIG. 3.

FIGS. 3 and 4 show a modification of the magnetic apparatus 10 of FIGS. 1 and 2 in which the same support plate 14 is used, but the magnets have been changed. In this case, the rows of small magnets 22 and 24 in the rows 40 and 42 have been replaced by small permanent strip magnets 82 and 84 also arranged in these rows. In particular, the strip magnet 82 has top and bottom regions 86*a* and 86*b* having north and south magnetic polarity, while the strip magnet 84 has top and bottom regions 88*a* and 88*b* with south and north magnetic polarity. Since the strip magnets are configured to be small, i.e., to have dimensions transverse to their respective row (in this case widths W1) which are less than 0.25 in. or 6.35 mm, the magnetic field above the magnets will also have a rapid fall-off with distance like that realizable with the apparatus 10 of FIGS. 1 and 2. The apparatus 10 of FIGS. 3 and 4 can thus also be suitably used as an activator and/or deactivator for EAS tags.

As above indicated, the apparatus 10 of the present invention can be used to deactivate a magneto-mechanical EAS tag as well as activate such tag. To deactivate a magneto-mechanical EAS tag such as the tag 50 in FIG. 7, the entire length L of the two rows of magnets of the apparatus should span the length L1 of the tag and, therefore, its biasing element. This may require additional magnets than if the apparatus 10 were to be used merely as an activator.

Figure 5:
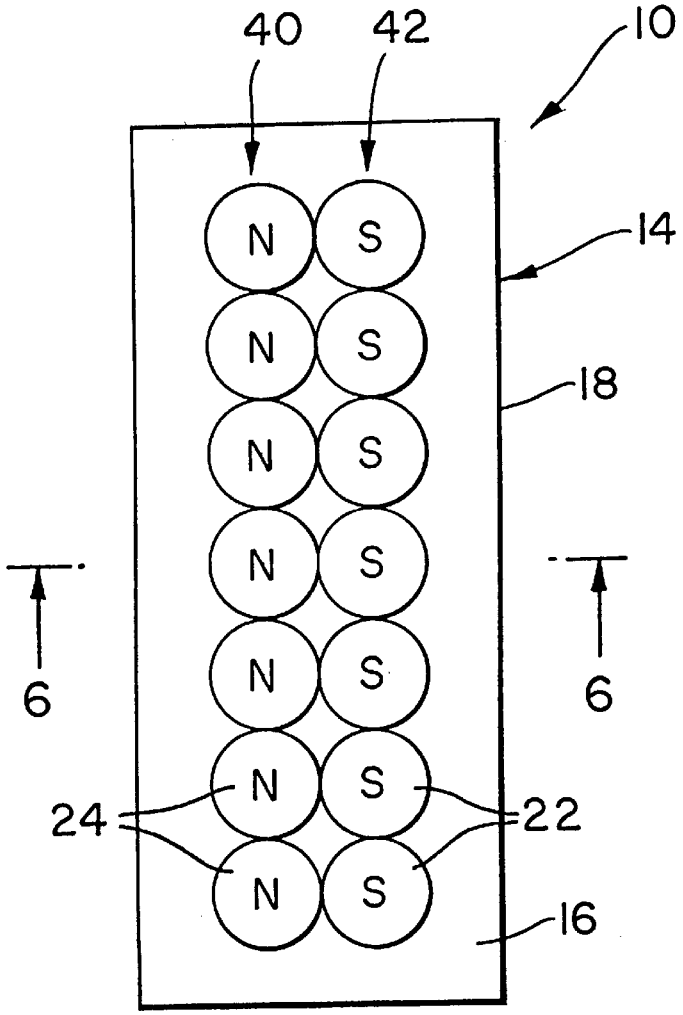
FIG. 5 shows a top view of an additional embodiment of the apparatus of the invention.
Figure 6:
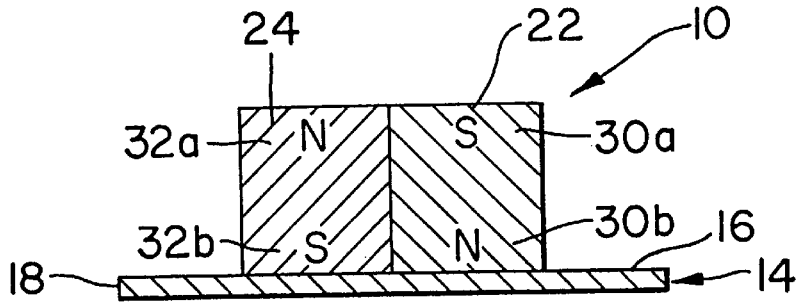
FIG. 6 shows a cross-sectional view of the apparatus of FIG. 5 taken along the lines 6—6 of FIG. 5.

FIGS. 5 and 6 show the apparatus 10 of FIGS. 1 and 2 modified to include additional magnets 22 and 24 in the rows 40 and 42. This ensures that the rows of magnets encompass the length L1 of the tag 50 of FIG. 7 so that the tag can be deactivated. FIG. 8 shows such deactivation. In this case, the apparatus 10 is turned 90 degrees so that the rows of magnets are in parallel relation to the length of the tag 50 carried by the cassette 52. The cassette 52 is then swept across the width of the apparatus 10, as indicated by the arrows B—B, to magnetize the biasing element across its width W. This changes the magnetic state of the biasing element, thereby deactivating the tag 50.

Figure 9:
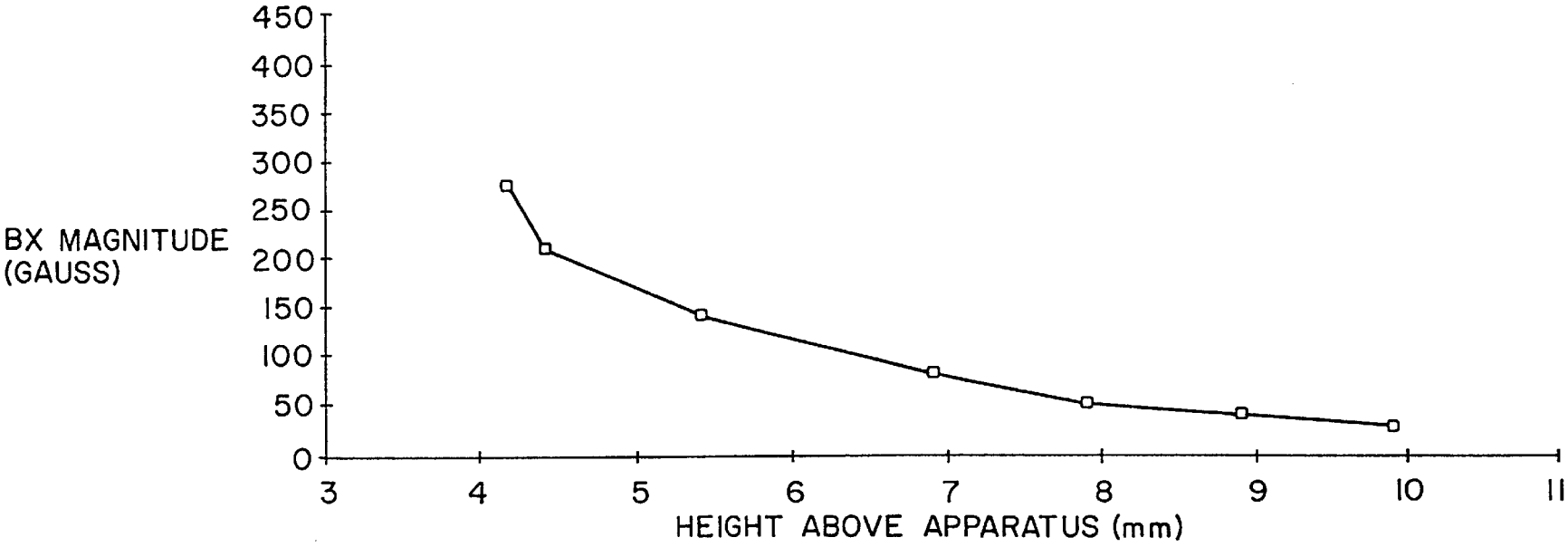
FIG. 9 shows a plot of the $B_x$ component of the magnetic field of the apparatus of the invention.

FIG. 9 illustrates a representative graph of the $B_x$ magnetic flux of a fabricated apparatus 10 versus height above the apparatus 10. The curved slope indicates a rapid magnetic field falloff with increased height above the apparatus.

The support 14 of the apparatus 10 may be formed of any low coercive force, high saturation induction material which allows for efficient concentration of magnetic flux of permanent magnets. In addition, the support 14 may also be heat-treated to improve its magnetic properties.

In FIG. 7, the apparatus 10 is shown as disposed in a rectangular-shaped retainer or housing 56. However, the housing of the apparatus 10 can take on a variety of other configurations. For example, the housing may be in the form of a handheld unit for use by a cashier. It may also be in the form of a pad or other assembly to provide a secure environment for the apparatus 10. Additionally, it may be an automated arm for a conveyor assembly or like housing.

Moreover, more than one magnetic apparatus 10 may be included in a housing to help insure complete activation or deactivation of the EAS tag or to activate or deactivate more than one tag at a time. If more than one apparatus is used, the apparatuses would be positioned end to end in the housing.

In the above description, the apparatus 10 was discussed in terms of its use to activate and/or deactivate a magneto-mechanical EAS tag 50 by magnetizing the biasing element of the tag. The apparatus 10 can also be used to magnetize the biasing element of a harmonic EAS tag along its length, similarly to magnetizing the tag 50 in FIG. 7 along its length, to deactivate the tag. The apparatus 10 thus has application as an activator and/or deactivator for magneto-mechanical EAS tags and a deactivator for harmonic EAS tags.

Various types of magnets may be used for the permanent magnets of the apparatus 10. The magnets used should have high retentivity, remanence and coercive force. These properties are usually found in the above-mentioned SmCo and NdFeb materials. A typical remanence and coercive force for these materials is as follows: 1–1.2 Tesla; and 7–18 kOe.

Figure 10:
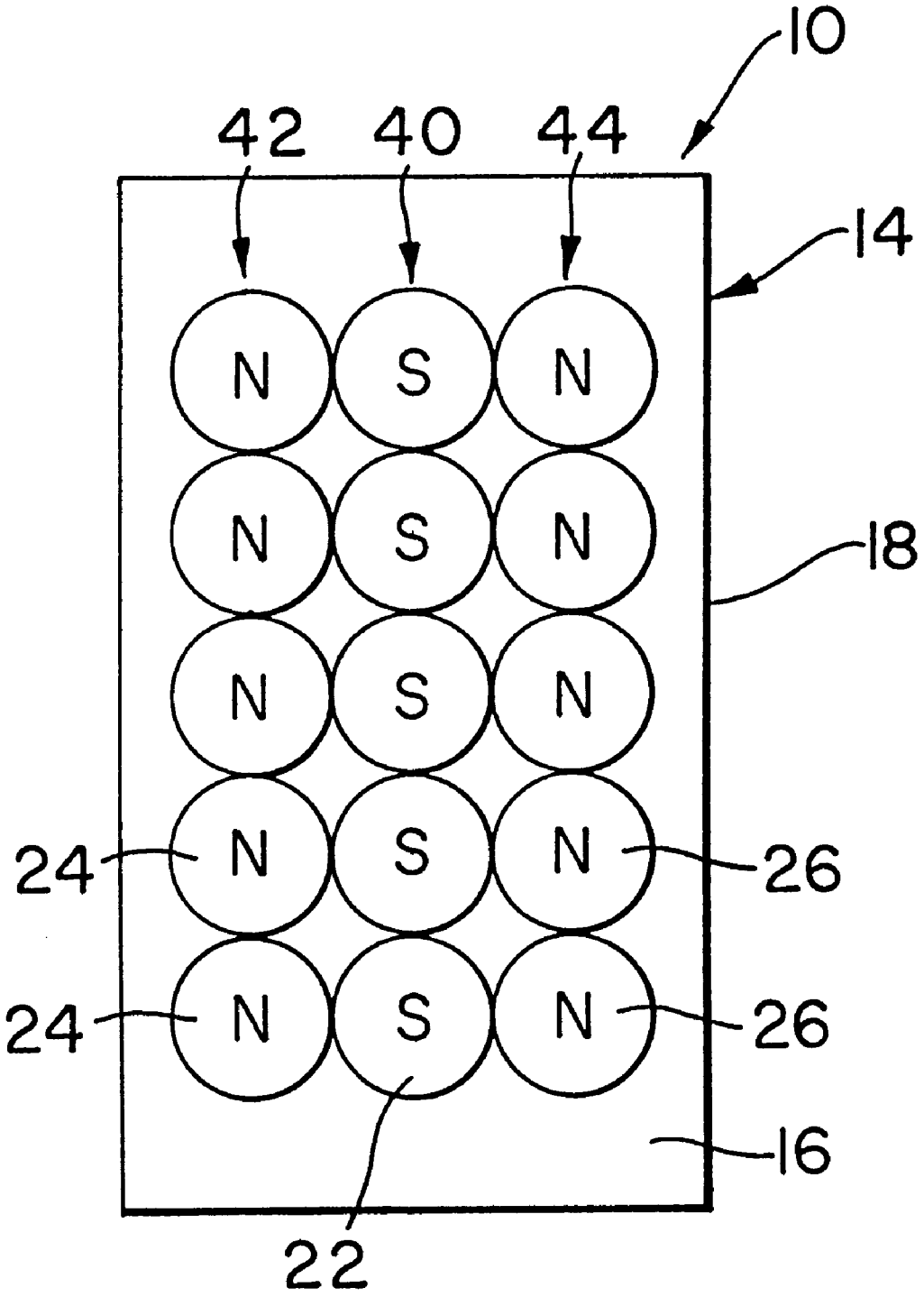
FIG. 10 shows a top view of another modified embodiment of the apparatus of the invention.

In all cases it is understood that the above-described configurations are merely illustrative of the many possible specific embodiments which represent applications of the present invention. Numerous and varied other configurations, can be readily devised in accordance with the principles of the present invention without departing from the spirit and scope of the invention. For example, while the rows of adjacent magnets have been illustrated in the apparatus as in contact with each other, the adjacent magnets could also be slightly spaced from each other. A particular spacing might be equal to or less than ten percent of the transverse dimension of each magnet, i.e., the dimension transverse to each row. Additionally, as shown in FIG. 10, a third row 44 of magnets 26 can be added to the apparatus 10. The magnets 26 have top and bottom regions similar to those of the magnets 24 of the row 42. With this configuration, the apparatus 10 magnetizes the biasing element of the tag 50 so that it has a first magnetized polarity when swept in one direction across the element and a second magnetized polarity when swept in the opposite direction across the element.

What is claimed is:

1. An apparatus for use in activating and/or deactivating an EAS tag, comprising:

a support;

a first number of one or more discrete first small magnets arranged in a first row;

a second number of one or more discrete second small magnets arranged in a second row;

each first magnet being arranged adjacent to a second magnet and having a first region of a first magnetic polarity and an opposing second region supported on said support and of a second magnetic polarity;

and each second magnet having a first region of said second magnetic polarity and an opposing second region supported said support and of said first magnetic polarity.

2. An apparatus in accordance with claim 1 wherein:

said first number of one or more discrete first small magnets includes a first plurality of first permanent magnets arranged adjacent one another in said first row; and said second number of one or more discrete second small magnets includes a second plurality of second permanent magnets arranged adjacent one another in a second row adjacent said first row.

3. An apparatus in accordance with claim 2 wherein:

each first magnet is cylindrically shaped and each second magnet is cylindrically shaped.

4. An apparatus in accordance with claim 3 wherein:

each first magnet and each second magnet has a diameter equal to or less than 6.35 mm.

5. An apparatus in accordance with claim 4 wherein:

said first number is such that the total extent of said first magnets along said first row is at least equal to the width of said EAS tag;

and said second number is equal to said first number.

6. An apparatus in accordance with claim 4 wherein:

said first number is such that the total extent of said first magnets along said first row is at least equal to the length of said EAS tag;

and said second number is equal to said first number.

7. An apparatus in accordance with claim 3 wherein:

each first magnet and each second magnet comprises one of a SmCo and NdFeB material.

8. An apparatus in accordance with claim 3 wherein:

said support comprises a plate member formed of magnetically soft steel.

9. An apparatus in accordance with claim 3, further comprising adhering means for adhering said first number of one or more first small magnets and said second number of one or more second small magnets to said support.

10. An apparatus in accordance with claim 3, further comprising retaining means for further holding said first number of one or more first small magnets and said second number of one or more second small magnets.

11. An apparatus in accordance with claim 10, further comprising:

a housing for housing said support, said retaining means, said first number of one or more first small magnets and said second number of one or more second small magnets.

12. An apparatus in accordance with claim 3, further comprising:

a housing for housing said support and said first number of one or more first small magnets and said second number of one or more second small magnets.

13. An apparatus in accordance with claim 3 wherein:

said first magnetic polarity is north and said second magnetic polarity is south.

14. An apparatus in accordance with claim 1, wherein each said first magnet and each second magnet is of a dimension transverse to its respective row which is equal to or less than 6.35 mm.

15. An apparatus in accordance with claim 1, wherein:

said first number of one or more first small magnets includes a first small strip magnet arranged along said first row and having a first region of a first magnetic polarity and a second opposing region supported on said support and of a second magnetic polarity;

said second number of one or more second small magnets includes a second small strip magnet arranged along said second row and having a first region of said second magnetic polarity and a second region supported on said support and of said first magnetic polarity.

16. An apparatus in accordance with claim 15, wherein each of said first and second strip magnets has a width which is equal to or less than 6.35 mm. and is positioned in a direction transverse to the respective row of the strip magnetic.

17. An apparatus in accordance with claim 16, wherein said first polarity is a north polarity and a second polarity is a south polarity.

18. An apparatus in accordance with claim 1, wherein said first polarity is a north polarity and said second polarity is a south polarity.

19. An apparatus in accordance with claim 1 wherein:

said support comprises a plate.

20. An apparatus in accordance with claim 19 wherein:

said plate comprises a magnetically soft steel.

21. An apparatus in accordance with claim 1, further comprising:

a third number of one or more discrete third small magnets arranged in a third row;

each third magnet being arranged adjacent to a second magnet and having a first region of said first magnetic polarity and an opposing second region supported on said support and of a second magnetic polarity.

22. An apparatus in accordance with claim 21, wherein:

each first, second and third magnet is cylindrically shaped.

23. An apparatus in accordance with claim 22, wherein:

each first, second and third magnet has a diameter equal to or less than 6.35 mm.

24. An apparatus in accordance with claim 21, wherein:

said first number of one or more first small magnets includes a first small strip magnet;

said second number of one or more second magnets includes a second small strip magnet; and said third number of one or more third magnets includes a third small strip magnet.

25. An apparatus in accordance with claim 24, wherein:

each of said first, second and third strip magnets has a width which is equal to or less than 6.35 mm and is in a direction transverse to the respective row of the strip magnet.

* * * * *